United States Patent [19]

Perotto et al.

[11] Patent Number: 5,050,319

[45] Date of Patent: Sep. 24, 1991

[54] INNER LINING FOR SKI BOOT

[75] Inventors: Riccardo Perotto, Venegazzu; Antonio Dalla Lana, Montebelluna, both of Italy

[73] Assignee: Lange International S.A., Fribourg, Switzerland

[21] Appl. No.: 434,911

[22] Filed: Nov. 13, 1989

[30] Foreign Application Priority Data

Nov. 24, 1988 [CH] Switzerland ..... 4365/88

[51] Int. Cl.[5] ..... A43B 5/04

[52] U.S. Cl. ..... 36/117; 36/55; 36/88

[58] Field of Search ..... 36/117, 118, 119, 120, 36/121, 131, 55

[56] References Cited

U.S. PATENT DOCUMENTS

| | | | |
|---|---|---|---|
| 4,095,355 | 6/1978 | Annovi | 36/118 |
| 4,657,609 | 4/1987 | Hensler | 36/117 X |
| 4,724,627 | 2/1988 | Sisco | 36/119 |

FOREIGN PATENT DOCUMENTS

| | | | |
|---|---|---|---|
| 0107841 | 5/1984 | European Pat. Off. | 36/119 |
| 0317798 | 5/1989 | European Pat. Off. | 36/117 |
| 2459014 | 2/1981 | France | 36/117 |
| 0626793 | 12/1981 | Switzerland | 36/117 |
| 0654467 | 2/1986 | Switzerland | 36/119 |

*Primary Examiner*—Steven N. Meyers
*Assistant Examiner*—Beth Anne Cicconi
*Attorney, Agent, or Firm*—Kane Dalsimer Sullivan Kurucz Levy Eisele and Richard

[57] ABSTRACT

Inner lining (1) for a ski boot, comprising at least one part of relatively rigid, compact synthetic material lined, on the inside, with a synthetic material of lesser rigidity (4). The relatively rigid synthetic material possesses at least one cut-out (5, 6) of continuous contour so that the rigid part adapts better to the morphology of the foot or of the ankle.

11 Claims, 2 Drawing Sheets

INNER LINING FOR SKI BOOT

FIELD OF THE INVENTION

The present invention relates to an inner lining for a ski boot, possessing parts made from a relatively rigid, compact synthetic material lined on the inside with a synthetic material of less rigidity. An inner lining is understood to mean any part intended to line the bare shell, such as a liner, tongue, front and rear spoilers, edges, etc.

PRIOR ART

This type of lining is commonly used in ski boots of injection-molded synthetic material. In these linings, in particular the liners, the compact synthetic material does not always possess the flexibility necessary for perfect fitting of the liner to the shape of the foot or of the ankle and for deformation when the leg is flexed. This is particularly the case with the tongue intended to spread the clamping pressure exerted by the buckles of the boot on the instep and on the anterior part of the bottom of the leg.

For this purpose, the tongue possesses a relatively hard and rigid outer part and an inner lining comprising at least one compressible elastic layer. The known tongues do not, however, possess a truly anatomical shape, but simply a rounded shape fitting more or less well the shape of the instep and of the leg. For the practice of skiing, the boot must be tightly clamped on the foot and the clamping pressure is generally not spread in a uniform manner over the foot by the tongue, but on the contrary localized zones of compression are created, precisely by reason of the poor fitting of the shape of the tongue to the instep and to the leg, these localized zones of compression being unpleasant and capable of becoming painful after a certain time. These comments equally apply to the other parts of the lining made from a relatively hard plastic.

It would of course be possible to adapt the shape of the tongue and the other parts concerned to the morphology of the foot, but, bearing in mind the morphological differences between individuals, the adaptation would have to be done in an individual manner for each individual, which is not feasible in practice.

Moreover, so far as the tongue is concerned during forward flexion of the foot, the extensor muscle of the big toe tends to move forward and upward. However, if it is already compressed by the clamping of the boot, it is incapable of performing this natural movement. This comment also applies to other muscles and tendons such as the Achilles tendon, for example.

The object of the present invention is to provide an inner lining whose parts made from compact synthetic material automatically adapt, to the greatest extent possible, to the shape of the wearer's foot or ankle and provide little opposition to deformation during full flexion of the leg.

SUMMARY OF THE INVENTION

The inner lining according to the invention is a lining wherein at least one of the parts made from relatively rigid synthetic material possesses at least one cut-out of continuous contour.

On the tongue of the liner, for example, the cut-out may be single, that is to say may extend both over the instep and over the part of the tongue situated above the instep, or in two parts, one situated above the instep and the other above the part of the tongue situated above the instep.

The cut-out or cut-outs ensures or ensure good adaptation of the tongue to the morphology of the foot. The shape of the upper part of the cut-out takes into account the fact that the front lower part of the leg is not symmetrical. The inner part of the leg is essentially formed by the tibia, while the muscles occupy the outer part. The tongue of the liner according to the invention distributes pressure in a more uniform manner, because the tongue is always in contact uniformly with the surface of the tibia. The transverse rigidity of the tongue is reduced and the pressure and the lateral friction caused by the edges of known tongues, which tend to dig into the calf, particularly on the inside of the leg, are eliminated.

The part of the cut-out, or the cut-out in the tongue, situated on the instep reduces the rigidity of the tongue at this point and permits the long extensor muscles of the big toe to rise without encountering excessive resistance. This part of the cut-out is preferably offset laterally towards the inside of the foot in a manner such that the centre of the cut-out is situated on the long extensor muscle of the big toe.

BRIEF DESCRIPTION OF THE DRAWING

The attached drawing shows, by way of example, three embodiments of the invention.

DESCRIPTION OF THE PREFERRED EMBODIMENT(S)

Figure 1:
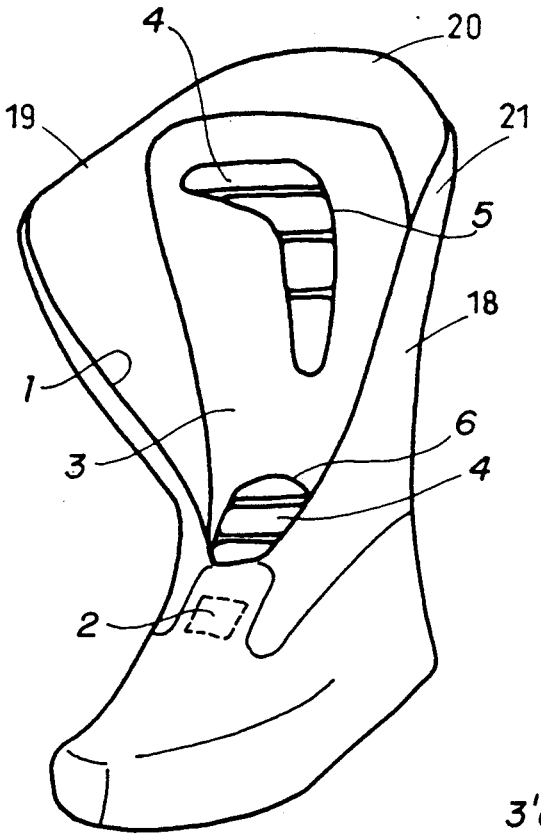
FIG. 1 shows a liner according to a first embodiment.
Figure 2:
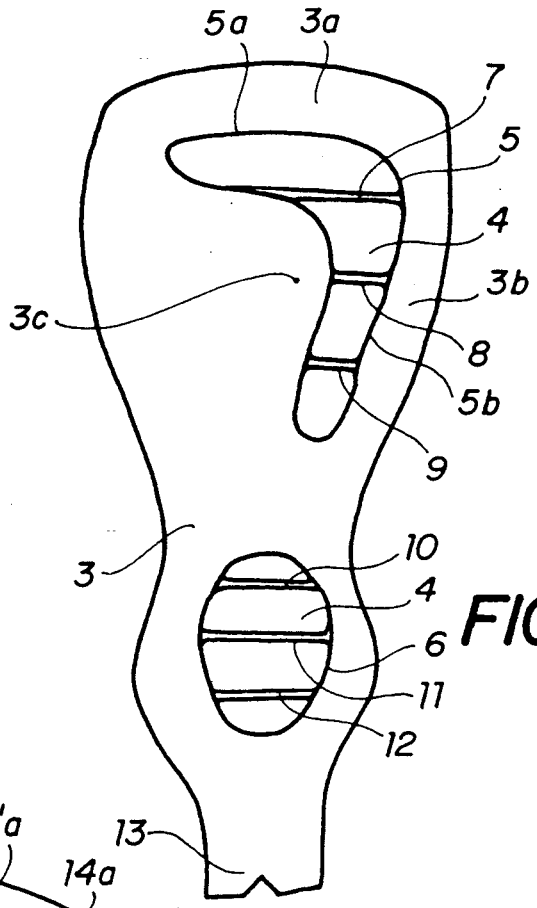
FIG. 2 is a plan view of the tongue of the liner according to FIG. 1.
Figure 3:
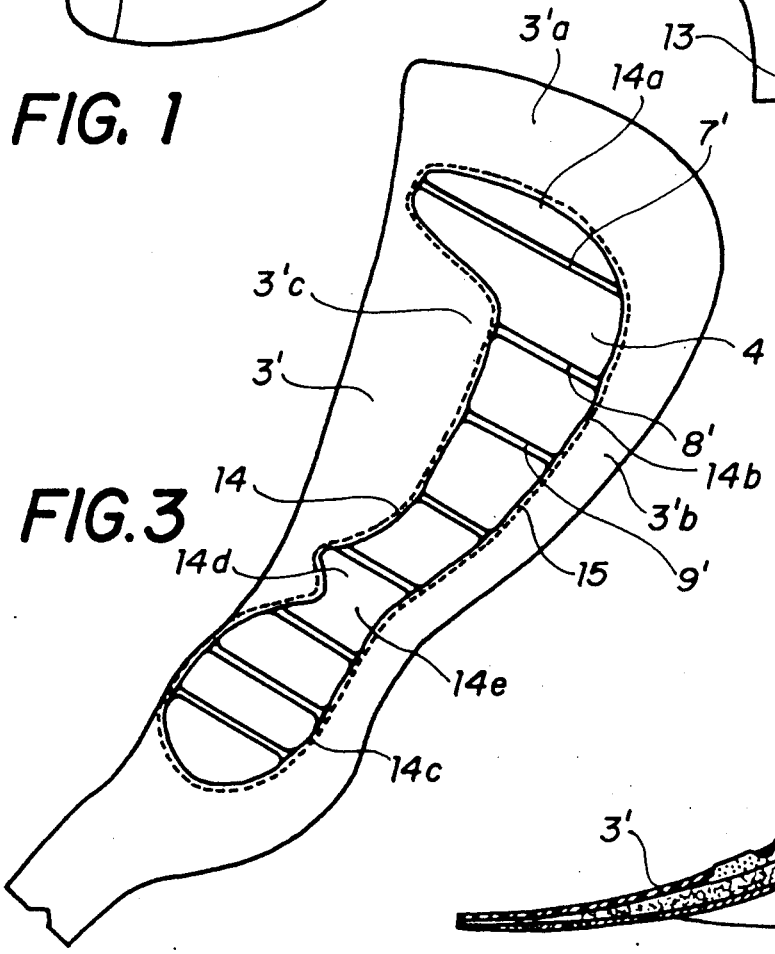
FIG. 3 is a perspective view of a second embodiment of the tongue which is capable of being used in the liner according to FIG. 1 instead of the tongue shown.
Figure 4:
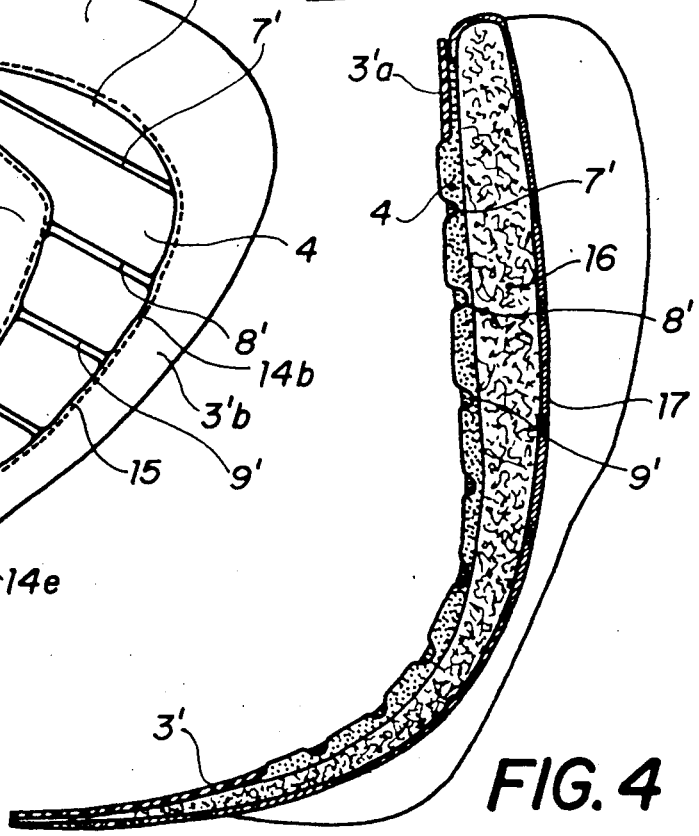
FIG. 4 is a view in median longitudinal section of the tongue shown in FIG. 3.

FIG. 1 shows a liner of known shape, in the form of a shoe, possessing at the front a deep scalloping 1 extending over the instep. This shoe may be of felt or of synthetic material covered with a soft lining. At a point 2 situated on the instep, on the inside of the liner, is fixed a tongue 3 of relatively rigid synthetic material which is thermoformed in the shape of a saddle in a manner such as to fit approximately the shape of the instep. This tongue 3 is lined internally with a synthetic foam 4 which appears through two cut-outs 5 and 6 in the tongue 3. The cut-out 5 possesses a first part 5*a* extending transversely slightly below the upper edge of the tongue 3, this part 5*a* being followed by a part 5*b* extending longitudinally over the left side of the tongue—or of the wearer, the liner shown being the liner for the right foot—that is to say on the inner side of the leg, substantially parallel to the lateral edge of the tongue 3. The lower end of the part 5*b* is just above the instep. The cut-out 6, on the other hand, is of oval shape and extends over the instep, in a manner such that it extends substantially equally on either side of the long extensor muscle of the big toe. In the cut-outs 5 and 6, the resistance of the foam 4 to deformation is increased by transverse grooves 7 to 12 obtained by hot-squeezing of the material 4. The tongue 3 is sewn to the point 2 of the liner by its end 13. The tongue 3 closes the scalloping 1 when the boot is closed. During clamping of the boot, the part 5*b* of the cut-out 5 permits the right-hand part, in the drawing, of the tongue to adapt better to the tibia, fitting closely to the inside of the leg, eliminating the zone of localized compression resulting from non-fitting of the curvature of the tongue to the shape of the tibia which possesses a ridge followed by an approximately planar surface. The upper part 3*a* of the tongue 3 situated above the part 5*a* of the cut-out 5 forms a transverse strip capable of being deformed in a different manner to the remainder of the tongue. During flexion of the leg, that is to say during pressure by the tibia on the tongue, this part 3*a* can flex both forwards and downwards, in a manner such that the upper edge of the tongue 3 does not exert painful pressure on the tibia. The part 3*b* of the tongue extending between the lateral edge and the part 5*b* of the cut-out 5 is likewise in the shape of a strip which can be deformed relatively easily. The L-shape of the cut-out 5 makes it possible to ensure a good fit of the tongue 3 on clamping and on flexion, while retaining a resistant part to receive the pressure of the clamping strap. This resistant part is essentially formed by the zone 3*c* situated within the L. Such a combination of features of rigidity and flexibility could not have been obtained by a median longitudinal cut-out or by two cut-outs parallel to the axis of the tongue.

The cut-out 6 has a double action. In the absence of such a cut-out, the flexion of the tongue 3 above the instep has the effect of reducing the transverse curvature of the tongue on the instep, the effect of which is to compress the long extensor muscle of the big toe. The presence of the cut-out 6 substantially reduces this action. On the other hand, the cut-out 6 makes it possible for the long extensor muscle of the big toe to rise, encountering only the slight resistance of the foam 4.

The tongue 3' shown in FIGS. 1 to 7 differs from the tongue 3 only in the shape of the cut-out. The tongue 3' possesses a single cut-out 14 extending over the majority of the length of the tongue. This cut-out 14 likewise possesses an upper part 14*a* extending transversely and parallel to the upper edge of the tongue 3', like the part 5*a* of the cut-out 5, this part 14*a* being followed by a part 14*b* extending laterally and substantially parallel to the inner lateral edge of the tongue, like the part 14*b* and connected to the part 14*c* of oval shape like the cutout 6 of the first embodiment, extending over the instep, by means of a part possessing firstly a widened portion 14*d* corresponding to the zone of flexion of the foot, followed by a narrowed part 14*e*. This tongue 3' possesses better flexibility on flexion than the tongue 3 of the first embodiment.

FIGS. 3 to 7 illustrate more completely the structure of the tongue. This structure is equally valid for the tongue 3 of the first embodiment. The edge of the cut-out is sewn to the lining 4 of the tongue by a seam 15. The foam 4 is itself lined with a thick layer of soft non-woven textile 16, lined internally with a fabric 17. On the tongue 3' are found the transverse crushed areas 7', 8', 9' etc., corresponding to the transverse crushed areas 7, 8, 9 etc.

Figure 5:
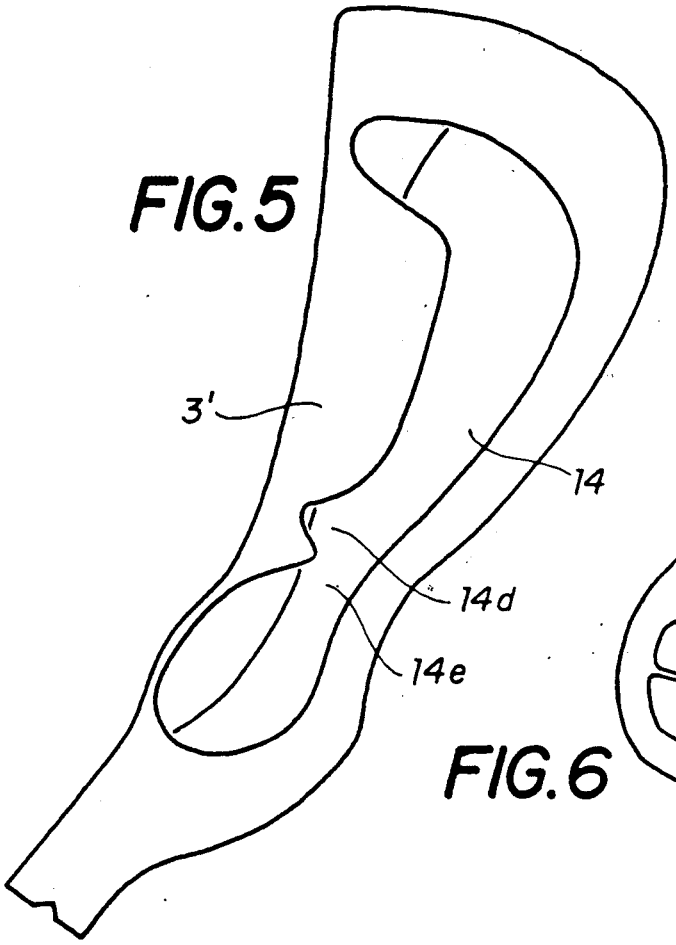
FIG. 5 shows the tongue of FIG. 3 without its lining.
Figure 6:
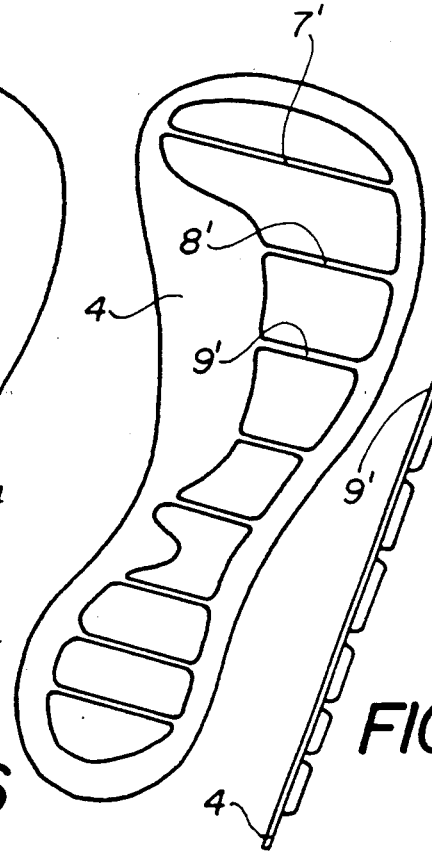
FIG. 6 shows the foam lining of this same tongue.
Figure 7:
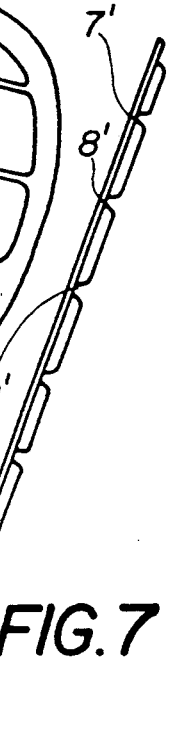
FIG. 7 is a profile view of the lining shown in FIG. 6.

The tongue 3' and the foam 4 are shown separately in FIGS. 5 to 7.

The shape and dimensions of the cut-out, or of the cut-outs, shown may of course differ slightly from the shapes and dimensions shown. The essential thing is to adhere to the arrangement and orientation claimed.

Instead of a synthetic foam, it is possible to use other thermoformable materials to produce the lining of the tongue. The only condition is that this material should be substantially less hard than the material of the tongue.

Figure 8:
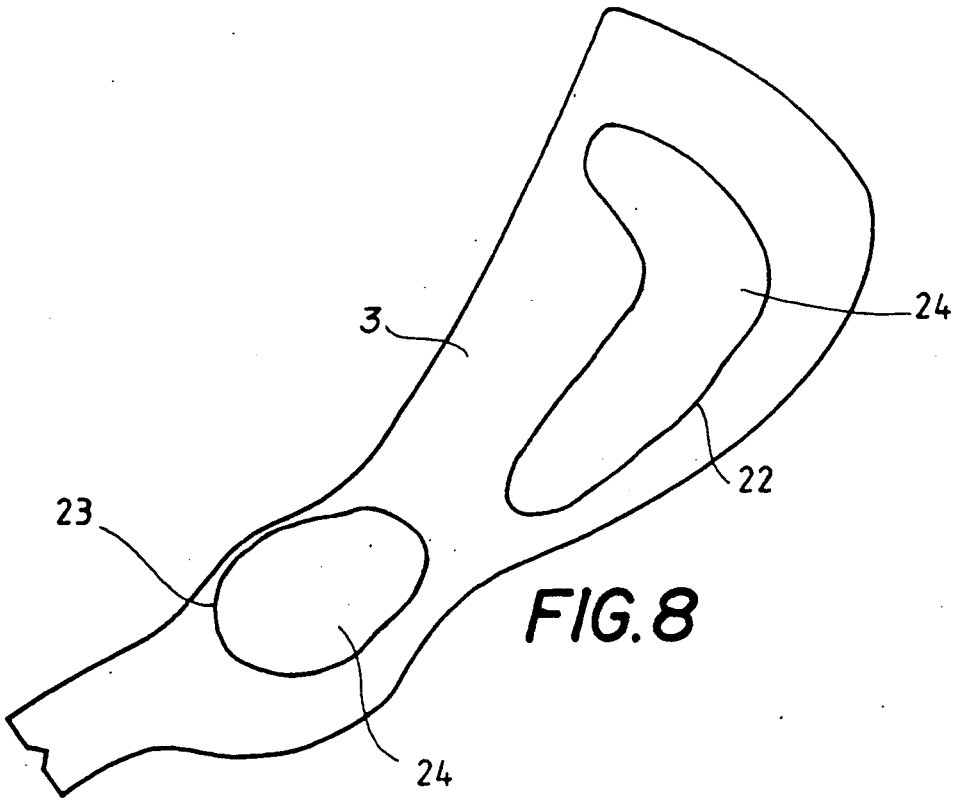
FIG. 8 shows a third embodiment of the tongue.

FIG. 8 illustrates a third exemplary embodiment. The material of the tongue 3 is, for example, the same as in the previous embodiments This tongue 3 possesses two cut-outs 22 and 23 analogous to the cut-outs 5 and 6 in FIGS. 1 and 2, but of a slightly different shape. This tongue is lined with a thermoformable synthetic material 24 which is substantially less hard than the tongue. This material 24 is given the desired thickness and shape by thermoforming, then the component obtained is fixed to the tongue 3 by stitching or by high-frequency welding.

By using, for the material 24, a material compatible with that of the tongue, for example of the same family but less hard, the material 24 can be fixed to the tongue by being molded or injected over it. Such a tongue is stronger; its manufacturing cost is reduced; its aesthetic appearance is improved and it is possible to obtain tongues of difference appearances.

Cut-outs could likewise be provided in the posterior part 18 of the liner, and also in the upper edges 19, 20 and 21 overlapping the shell of the boot and bearing against sensitive parts of the ankle and of the bottom of the calf.

In rear-entry boots, the rear part of the liner is replaced by a rear spoiler and the tongue by a front spoiler. The spoilers can be provided with adequate cut-outs like the tongue 3.

We claim:

1. An inner lining for a ski boot, comprised of a part made from a relatively hard synthetic material, said part defining an area said area being of such shape and contour as to generally conform to the shape of the instep and the forward portion of the lower leg, the part being lined internally on the area with a synthetic material of lesser hardness (4; 24), wherein the part made from a relatively hard synthetic material (3) possesses at least one cut-out aperture (5, 6; 14; 22, 23) of continuous contour, said cut out aperture extending over a portion of the instep and forward portion of the leg above the instep such that the synthetic material of lesser hardness spans the aperture and avoids localized zones of compression.

2. The inner lining as claimed in claim 1, wherein the synthetic material of lesser hardness is a foam (4).

3. The inner lining as claimed in claim 1, wherein the synthetic material of lesser hardness is fixed to the relatively hard synthetic material by stitching.

4. The inner lining as claimed in claim 1, wherein the synthetic material of lesser hardness is fixed to the relatively hard synthetic material by welding.

5. The inner lining as claimed in claim 1, wherein the synthetic material of lesser hardness is molded over the relatively hard synthetic material.

6. The lining as claimed in claim 1, more particularly a liner possessing, at the front, a deep scalloping (1) covered, on the inside, by a tongue (3) of relatively rigid synthetic material lined, on the inside, with at least one layer of a synthetic material of lesser hardness (4) said layer being a synthetic foam, said tongue being fixed by its lower end in a manner such as to cover the instep and the front part of the bottom of the leg, wherein the relatively hard synthetic material of the tongue possesses at least one cut-out aperture (5, 6; 14) of continuous contour the aperture being asymmetrical in shape extending transversely in the upper part of the tongue, substantially longitudinally and laterally over at least part of the height of the tongue, on the inner side of the leg and over at least part of the instep.

7. The liner as claimed in claim 6, wherein the tongue possesses a single cut-out (14).

8. The liner as claimed in claim 6, wherein the tongue possesses two cut-outs, one (5) extending over the part situated above the instep and the other (6) over the instep.

9. The liner as claimed in claim 6, wherein the middle of the cut-out (6), or the part of the cut-out (14) situated over the instep, is situated on the long extensal muscle of the big toe.

10. The liner as claimed in claim 6, wherein the part of the synthetic foam (4) situated in the cut-out or cut-outs possesses transverse zones compressed by thermo-forming.

11. The liner as claimed in claim 7, wherein the cut-out (14) of the tongue possesses a widened portion (14*d*) at the point of its flexion and in front a narrowed portion (14*e*) ensuring the continuity of the cut-out on the instep.

* * * * *